US007188453B2

(12) United States Patent
Greenberg et al.

(10) Patent No.: US 7,188,453 B2
(45) Date of Patent: Mar. 13, 2007

(54) MASONRY WALL SUPPORTED FENCE AND METHOD

(75) Inventors: Harold H. Greenberg, Prescott, AZ (US); Richard C. Campbell, Jr., Oro Valley, AZ (US)

(73) Assignee: Pyramid Retaining Walls, LLC, Prescott, AZ (US)

( * ) Notice: Subject to any disclaimer, the term of this patent is extended or adjusted under 35 U.S.C. 154(b) by 741 days.

(21) Appl. No.: 10/695,587

(22) Filed: Oct. 28, 2003

(65) Prior Publication Data

US 2005/0086882 A1 Apr. 28, 2005

(51) Int. Cl.
*E04F 17/00* (2006.01)

(52) U.S. Cl. ..... 52/223.7; 52/173.1; 52/293.2; 52/293.3; 52/295; 52/741.13; 256/65.14

(58) Field of Classification Search ..... 52/173.1, 52/223.7, 293.3, 295, 296, 741.13, 741.14, 52/562, 565–568, 293.2; 256/65.14, DIG. 5, 256/DIG. 6, 19
See application file for complete search history.

(56) References Cited

U.S. PATENT DOCUMENTS

| | | | | | |
|---|---|---|---|---|---|
| 1,647,925 | A | * | 11/1927 | May | 52/223.5 |
| 1,704,255 | A | | 3/1929 | Lewis | |
| 2,815,656 | A | | 12/1957 | Klein et al. | |
| 3,216,163 | A | * | 11/1965 | Carew | 52/251 |
| 3,413,773 | A | * | 12/1968 | Fitzgerald | 52/713 |
| 3,537,220 | A | | 11/1970 | Ellis | |
| 3,653,169 | A | * | 4/1972 | Jenner | 52/298 |
| 3,717,327 | A | * | 2/1973 | Schmidt et al. | 256/41 |
| 4,064,668 | A | | 12/1977 | Carter | |
| 4,353,194 | A | | 10/1982 | Norton | |
| 4,452,028 | A | | 6/1984 | Norton et al. | |
| 4,726,567 | A | | 2/1988 | Greenberg | |
| 4,750,306 | A | | 6/1988 | Granieri | |
| 4,809,955 | A | * | 3/1989 | Veilleux | 256/65.02 |
| 4,821,483 | A | | 4/1989 | Adams | |
| 5,007,218 | A | | 4/1991 | Bengtson et al. | |
| 5,547,169 | A | * | 8/1996 | Russell | 256/67 |
| 5,765,333 | A | * | 6/1998 | Cunningham | 52/481.1 |
| 5,794,921 | A | | 8/1998 | Greenberg | |
| 6,061,986 | A | * | 5/2000 | Canada | 52/561 |
| 6,431,797 | B2 | * | 8/2002 | Greenberg | 405/284 |
| 6,438,904 | B1 | * | 8/2002 | Anzai et al. | 52/167.1 |
| 6,460,308 | B1 | * | 10/2002 | Armstrong et al. | 52/698 |
| 6,632,048 | B2 | | 10/2003 | Greenberg | |

FOREIGN PATENT DOCUMENTS

| | | | |
|---|---|---|---|
| GB | 2 407 330 A | * | 4/2005 |
| JP | 5-248052 | * | 9/1993 |
| JP | 5-248053 | * | 9/1993 |
| JP | 6-212766 | * | 8/1994 |

* cited by examiner

*Primary Examiner*—Robert Canfield
(74) *Attorney, Agent, or Firm*—Cahill, von Hellens & Glazer P.L.C.

(57) ABSTRACT

A post tensioned wall includes accessible clamping plates at the ends of selected tensioning rods. Each post of a fence section is welded to a corresponding clamping plate to mechanically attach the post to the tensioning rod extending from a footing or foundation and through the wall.

28 Claims, 1 Drawing Sheet

MASONRY WALL SUPPORTED FENCE AND METHOD

BACKGROUND OF THE INVENTION

1. Field of the Invention

The present invention relates to a masonry wall system, and, more particularly to a wall having post tensioning elements for supporting fencing placed thereon.

2. Description of Related Art

The utilization of masonry walls is well known in the prior art. To attach fencing to the top of such walls generally requires combined efforts of brick layers and welders working together in order to properly support and anchor such fencing. This is a time consuming and expensive process. Nevertheless, it is done for both the functional purposes of a fence (security) and yet provides a view; it is sometimes referred to as a view fence.

SUMMARY OF THE INVENTION

The present invention incorporates a masonry wall structure that utilizes a foundation, a retaining wall or a footing for supporting the wall's first course of masonry block. Post-tensioning rods are imbedded in the footing and extend upwardly essentially vertically from the footing. A plurality of courses of masonry block are then placed on the footing with the respective post-tensioning rods extending through the cells therein. Some or all of the post-tensioning rods may extend upwardly beyond the top course of the masonry block. A clamping plate rests upon the top course and has an opening therein to permit the passage of the threaded end of a respective post-tensioning rod. A nut is placed on the threaded end to engage the clamping plate and place the post-tensioning rod in tension. A first section of fencing has a hollow post at one end and longerons with risers therebetween extend from the post. The lower end of the post is placed on the clamping plate to enclose the nut and the threaded end of the tensioning rod and is welded to the clamping plate. A second section of fencing has a similar hollow post at one end which is also welded to another clamping plate. The longerons of the first section are welded to the post of the second section. These steps are repeated until the desired length of fencing has been attached to the post tensioned wall. Alternatively, a post is welded to each selected clamping plate and fencing, longerons with risers therebetween, are welded adjacent to pairs of posts.

A primary object of the present invention is to provide a post tensioned masonry wall for supporting sections of fencing.

Another object of the present invention is to provide a post tensioned wall for supporting an inexpensively attached length of fencing.

Still another object of the present invention is to provide a length of fencing on top of a masonry wall that is structurally supported by rods extending vertically through the wall.

Yet another object of the present invention is to provide a wall incorporating post tensioning rods to compress the courses of blocks within the wall against a footing, a foundation or a retaining wall and to use the post tensioning rods as structural supports for a fence extending upwardly from the wall.

A further object of the present invention is to structurally interconnect fencing supported on a post tensioned wall with a footing or foundation supporting the wall.

A still further object of the present invention is to provide a wall system having a length of fencing welded to components of a supporting wall.

A yet further object of the present invention is to provide a method for welding a length of fencing to a masonry wall.

A yet further object of the present invention is to provide a method for structurally interconnecting a wall supported length of fencing with a footing or foundation supporting the wall.

A still yet further object of the present invention is to provide a method for attaching a length of fencing to rods of a masonry wall.

These and other objects of the present invention will become apparent to those skilled in the art as the description of the invention proceeds.

BRIEF DESCRIPTION OF THE DRAWINGS

The present invention will be described with greater specificity and clarity with reference to the following drawings, in which.

DESCRIPTION OF THE PREFERRED EMBODIMENT

Figure 1:
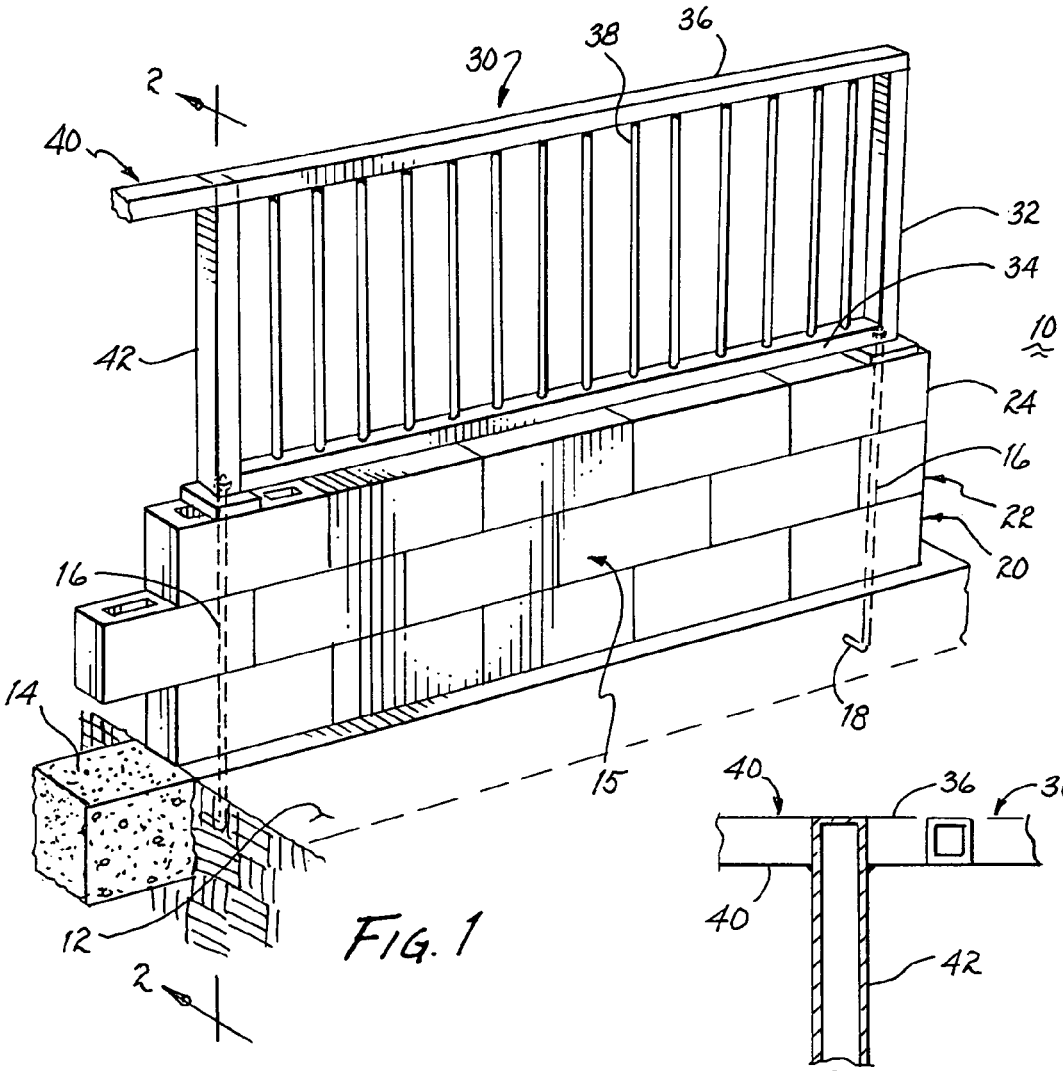
FIG. 1 is a perspective view of a wall system having a length of fencing supported upon a post tensioned wall.

Referring to FIG. 1, there is illustrated a wall supported fence system 10 extending from within ground 12 upwardly therefrom. A foundation, retaining wall, or footing 14 (hereinafter referred to as footing) is located generally below grade. A plurality of post tensioning rods 16 have their respective anchoring or bent ends 18 embedded within footing 14. A plurality of courses of masonry blocks define each of the courses. The term masonry block is intended to include hollow or cored building blocks of any material, whether of concrete, glass, man made materials, bricks, etc. For example, bricks having apertures or passageways disposed therein to accommodate penetrable engagement of the tensioning rods may be used. As illustrated, three courses 20, 22 and 24 are built upon footing 14. A length of fencing, of which section 26 is illustrated, is mounted upon course 24. It is presently contemplated that each section of fence will include a post 32 supporting a pair of longerons or a horizontal pair of members 34, 36 interconnected by a plurality of vertical risers 38. Upon assembly, the ends of horizontal members 34, 36 are welded, or otherwise attached to a further post 42 of an adjacent section of fence 40, as illustrated. In the alternative, posts 32 and 42 (and others) may be secured to course 24 and thereafter a section of horizontal members 34, 36 having risers 38 therebetween may be welded to the posts.

Figure 3:
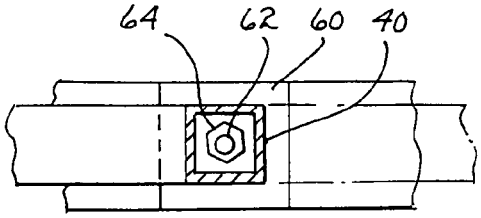
FIG. 3 is a cross sectional view taken along lines 3—3, as shown in FIG. 2.
Figure 2:
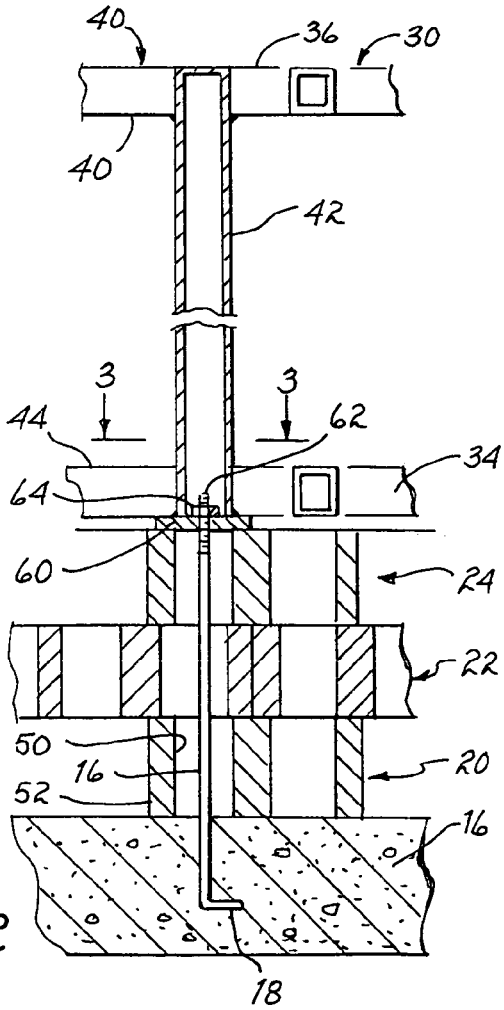
FIG. 2 is a cross sectional view taken along lines 2—2, as shown in FIG. 1.

Further details attendant the attachment of and support for fence section 30 will be described with particular reference to FIGS. 2 and 3. End 18 of post tensioning rod 16 is anchored in footing 14 and the bend of the end 18 prevents the rod from being drawn out of the footing. The rod extends upwardly from the footing through passageway 50 in the corresponding ones of masonry blocks 52 in alignment therewith in each of courses 20, 22 and 24. Top course 24 may be formed of solid top units (a block that has a solid top) or a flat rectangular element 54 may be disposed at the top course 24 in the conventional manner. Furthermore, paper may be placed in each exposed cell or passageway to serve as a dam and grout would be placed thereupon and troweled flat with the top of the course. These types of construction for the tops of masonry block walls are well known to those skilled in the art. A weldable clamping plate 60 rests upon top course 24 for penetrably receiving threaded end 62 of the rod. A nut 64 is brought into threaded engagement with end 62 and tightened an amount sufficient to place tensioning rod 16 in tension to enhance the structural properties of the wall.

Conventionally, the center to center length of each fence section 30 is eight feet but such length may vary as a function of engineering considerations and expected loads. Moreover, the spacing between the post tensioning rods may vary for the same reasons. Accordingly, wall 15 includes tensioning rods 16 that are eight feet a part from one another. After wall 15 has been constructed and cured, the lower end of post 42, which post is hollow as illustrated, is welded to clamping plate 60. Protruding end 62 of the tensioning rod and nut 64 are disposed within the post, as illustrated. Thereafter, the post of another fence section, such as post 32, is similarly welded to another clamping plate 60. The ends of horizontal members 34, 36 are then welded to post 32. Further fence sections are similarly attached to wall 15 with the respective horizontal members being welded to the post of an adjacent fence section. As noted above, posts 42, 32 may be first welded to the respective clamping plates and thereafter a fence section including members 34, 36 with risers therebetween is welded to adjacent posts.

By using tensioning rods 16 in wall section 15, its robustness and structural strength is greatly enhanced. Because of the forces resulting from tightening nut 64 against each of clamping plates 60, the clamping plates become extremely sturdy structural elements in structural engagement with footing 14. That is, wall 15, tensioning rod 16, plate 60 and footing 14 become in the nature of a unitary structural element of great robustness. Upon welding the posts of each of the fence sections to respective ones of the clamping plates, these posts become part of wall 15 and footing 14. Thus, any lateral forces imposed upon any of the fence sections will be resisted by the unitary nature of the wall as a result of the tensioning rods being anchored in the footing along with the support being provided by the wall.

Rods, such as conventional rebars may be used in place of the above discussed tensioning rods. They would extend from within the footing and be grouted in the conventional manner to become a part of wall 15. A plate, such as plate 60, would be welded, threaded or otherwise attached to the upper end of the rods. As described above, each of the posts would be welded to one of these plates. Alternatively, these rods could be interleaved with or otherwise used in combination with tensioning rods 16 as a function of engineering considerations, costs, etc.

It may be further noted that the construction of wall 15 does not require the learning of new skills by bricklayers or those who have achieved proficiency in building walls of masonry block. Each of the fence sections can be assembled off site using conventional techniques known to welders and fabricators of fences. The assembly of each fence section upon the wall requires only conventional skills of a welder to weld the bottom end of each post to a corresponding clamping plate and the welding of the free ends of each pair of horizontal members of a section to the posts.

In summary, the construction of each of the components and the final assembly of wall supported fence system 10 is accomplished by exercise of conventional skills known to artisans in the respective disciplines. The lack of requirement for extraordinary skills or unusual techniques greatly reduces the costs of construction and assembly of the present invention.

We claim:

1. A wall and fence structure, said structure comprising in combination:

a) a post tensioned wall having exposed clamping plates of tensioning rods disposed thereon;

b) a post secured to selected ones of said clamping plates; and c) a fence extending between adjacent ones of said posts.

2. The wall and fence structure as set forth in claim 1 including a footing for supporting said wall.

3. The wall and fence structure as set forth in claim 2 wherein selected ones of said tensioning rods include a lower end anchored in said footing and having an upper end extending above the top course of said wall in penetrable engagement with one of said clamping plates.

4. The wall and fence structure as set forth in claim 3 wherein said upper end is threaded and including a nut for threaded engaging said upper end.

5. The wall and fence structure as set forth in claim 4 wherein each of said posts is hollow proximate its lower end to receive and enclose said upper end and said nut.

6. The wall and fence structure as set forth in claim 5 wherein each of said posts is welded to a respective one of said clamping plates.

7. The wall and fence structure as set forth in claim 6 wherein said fence includes at least a pair of members having risers extending therebetween.

8. The wall and fence structure as set forth in claim 7 wherein said members extend between and are welded to adjacent posts.

9. A wall and fence structure, said structure comprising in combination:

a) a post tensioned wall having accessible clamping plates associated with tensioning rods disposed within said wall;

b) at least a pair of posts, each post of said at least a pair of posts being welded to one of said clamping plates; and c) a fence section secured to and intermediate a pair of posts of said at least a pair of posts.

10. The wall and fence structure as set forth in claim 9 wherein said fence section includes a pair of horizontal members extending from one post of said at least one pair of posts and risers disposed intermediate said pair of horizontal members.

11. The wall and fence structure as set forth in claim 9 wherein said fence section includes a pair of horizontal members having risers disposed therebetween.

12. The wall and fence structure as set forth in claim 9 including a footing for supporting said wall.

13. The wall and fence structure as set forth in claim 12 wherein said tensioning rods extend upwardly from said footing.

14. The wall and fence structure as set forth in claim 13 wherein said tensioning rods include a bent end disposed in said footing.

15. A wall and fence structure, said structure comprising in combination:

a) a wall having exposed plates at the upper ends of rods disposed thereon;

b) a post welded to selected ones of said plates; and c) a fence extending between adjacent ones of said posts.

16. The wall and fence structure as set forth in claim 15 wherein selected ones of said rods include a lower end anchored in the footing and having an upper end extending above a top course of said wall in penetrable engagement with one of said plates.

17. A wall and fence structure, said structure comprising in combination:

a) a wall having accessible plates associated with rods disposed within said wall;

b) at least a pair of posts, each post of said at least a pair of posts being welded to one of said plates; and c) a fence section secured to and intermediate a pair of posts of said at least a pair of posts.

18. The wall and fence structure as set forth in claim 17 wherein said fence section includes a pair of horizontal members extending from one post of said at least one pair of posts and risers disposed intermediate said pair of horizontal members.

19. The wall and fence structure as set forth in claim 17 including a footing for supporting said wall.

20. The wall and fence as set forth in claim 19 wherein said rods extend upwardly from said footing.

21. A method for constructing a wall and fence structure, said method comprising the steps of:

a) pouring a footing;

b) encapsulating the lower end of a plurality of vertically extending tensioning rods in the footing;

c) laying at least one course on the footing in penetrable engagement with the tensioning rods;

d) post tensioning the at least one course by placing a clamping plate in penetrable engagement with exposed threaded upper ends of the tensioning rods and threadedly engaging the upper end with a nut;

e) welding a post to selected ones of the exposed clamping plates; and f) interconnecting each pair of posts with a section of fence.

22. The method as set forth in claim 21 wherein each section of fence includes a pair of horizontal members interconnected with risers and wherein said step of interconnecting includes the step of welding the horizontal members to the corresponding posts.

23. The method as set forth in claim 21 wherein at least the lower end of each of the posts is a hollow end and wherein said step of welding includes the step of inserting the upper end and the nut into the hollow end.

24. The method as set forth in claim 21 wherein the step of laying includes the step of laying a plurality of courses.

25. The method as set forth in claim 21 wherein the step of laying includes the step of laying concrete masonry blocks.

26. The method as set forth in claim 21 wherein the step of laying includes the step of laying bricks having at least one passageway extending therethrough.

27. A method for constructing a wall and fence structure, said method comprising the steps of:

a) pouring a footing;

b) encapsulating the lower end of a plurality of vertically extending rods in the footing;

c) laying at least one course on the footing in penetrable engagement with the rods;

d) placing a plate in penetrable engagement with an exposed upper end of selected ones of the rods;

e) welding a post to selected ones of the exposed plates; and f) interconnecting each pair of posts with a section of fence.

28. The method as set forth in claim 27 wherein the step of laying includes the step of laying a plurality of courses.

* * * * *